US005293013A

United States Patent [19]

Takahashi

[11] Patent Number: 5,293,013

[45] Date of Patent: Mar. 8, 1994

[54] SWITCHING CABLE

[75] Inventor: Toshiyuki Takahashi, Nakano, Japan

[73] Assignee: Supital Sangyo Co., Ltd., Tokyo, Japan

[21] Appl. No.: 905,400

[22] Filed: Jun. 29, 1992

[30] Foreign Application Priority Data

Feb. 6, 1992 [JP] Japan ..... 4-4277[U]

[51] Int. Cl.[5] ..... H01R 13/70

[52] U.S. Cl. ..... 200/51 R; 439/620

[58] Field of Search ..... 200/50 R, 51.09, 51.02, 200/51.05, 51.06, 43.02, 51 R, 51.07, 51.08, 51.03, 51.04; 439/141, 620

[56] References Cited

U.S. PATENT DOCUMENTS

| | | | |
|---|---|---|---|
| 2,114,152 | 4/1938 | Shaw | 200/51 R |
| 2,761,028 | 8/1956 | Teetor | 200/51 R |
| 3,034,000 | 5/1962 | Todd | 439/620 X |
| 3,317,880 | 5/1967 | Meyer | 200/51 R |
| 4,463,228 | 7/1984 | Osika | 200/51 R |
| 4,579,407 | 4/1986 | Shimada | 439/620 X |
| 4,725,698 | 2/1988 | Takai et al. | 200/51 R X |
| 4,969,834 | 11/1990 | Johnson | 439/141 |
| 5,026,293 | 6/1991 | Wilson | 439/620 X |

*Primary Examiner*—Glenn T. Barrett
*Attorney, Agent, or Firm*—Kanesaka and Takeuchi

[57] ABSTRACT

A switching cable, for connecting a peripheral machine or a computer with another computer, comprises a pair of connectors each having a plurality of pins, a plurality of wires each adapted to connect each pin of one of the connectors with each pin of the other connector, and a switching device mounted on at least one of the connectors for switching over the connecting state of the wires.

5 Claims, 3 Drawing Sheets

SWITCHING CABLE

BACKGROUND OF THE INVENTION

1. Field of the Invention

This invention relates to a cable for use in connecting a computer to a peripheral equipment or the like.

2. Description of the Related Art

Conventionally, when connecting a computer to a peripheral equipment by a cable, it is a common practice to fix the cable at both the sender's side and the receiver's side, which is a straight connection.

Whereas when using a cable in data communication between computers or in connection between a computer and a scanner, the sending terminal and the receiving terminal are mutually reversed to exchange data, which is a reverse connection.

Heretofore since there are such two kinds of cable connections, a wrong cable has oftentimes been taken. A shop must have both kinds of cables, which increases the number of goods in stock.

SUMMARY OF THE INVENTION

It is an object of this invention to provide a cable which is usable both in straight connection and reverse connection.

According to this invention, there is provided a switching cable for connecting a peripheral machine or a computer to another computer, the switching cable comprising: a pair of connectors each having a plurality of pins; a plurality of wires each adapted to connect the individual pins of one of the connectors with the individual pins of the other connector; and a switching device mounted on at least one of the connectors for a switching over the connecting state of the wires.

With this arrangement, it is possible to set selectively straight connection or reverse connection by turning the switching device, depending on the kind of equipment to which a computer is to be connected.

DETAILED DESCRIPTION

Figure 1:
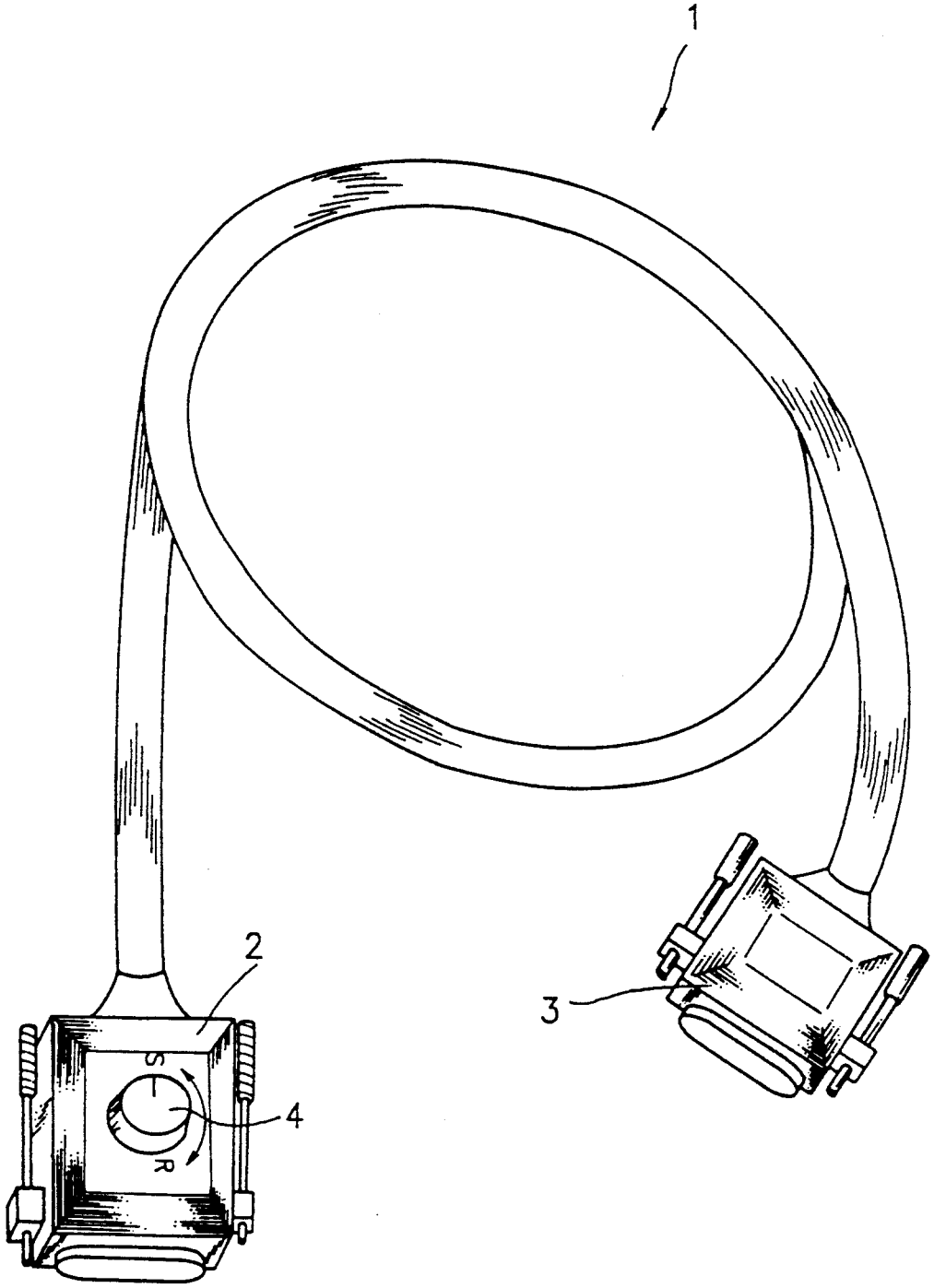
FIG. 1 is a perspective view of a switching cable according to one embodiment of this invention.

FIG. 1 shows a switching cable 1 of the first embodiment. The switching cable 1 has a pair of opposite connectors 2, 3; on one connector 2, a rotary switch 4 serving as a switching device is mounted for selectively switching over the connection of internal wires between straight (S) and reverse (R) connections.

Figure 3:
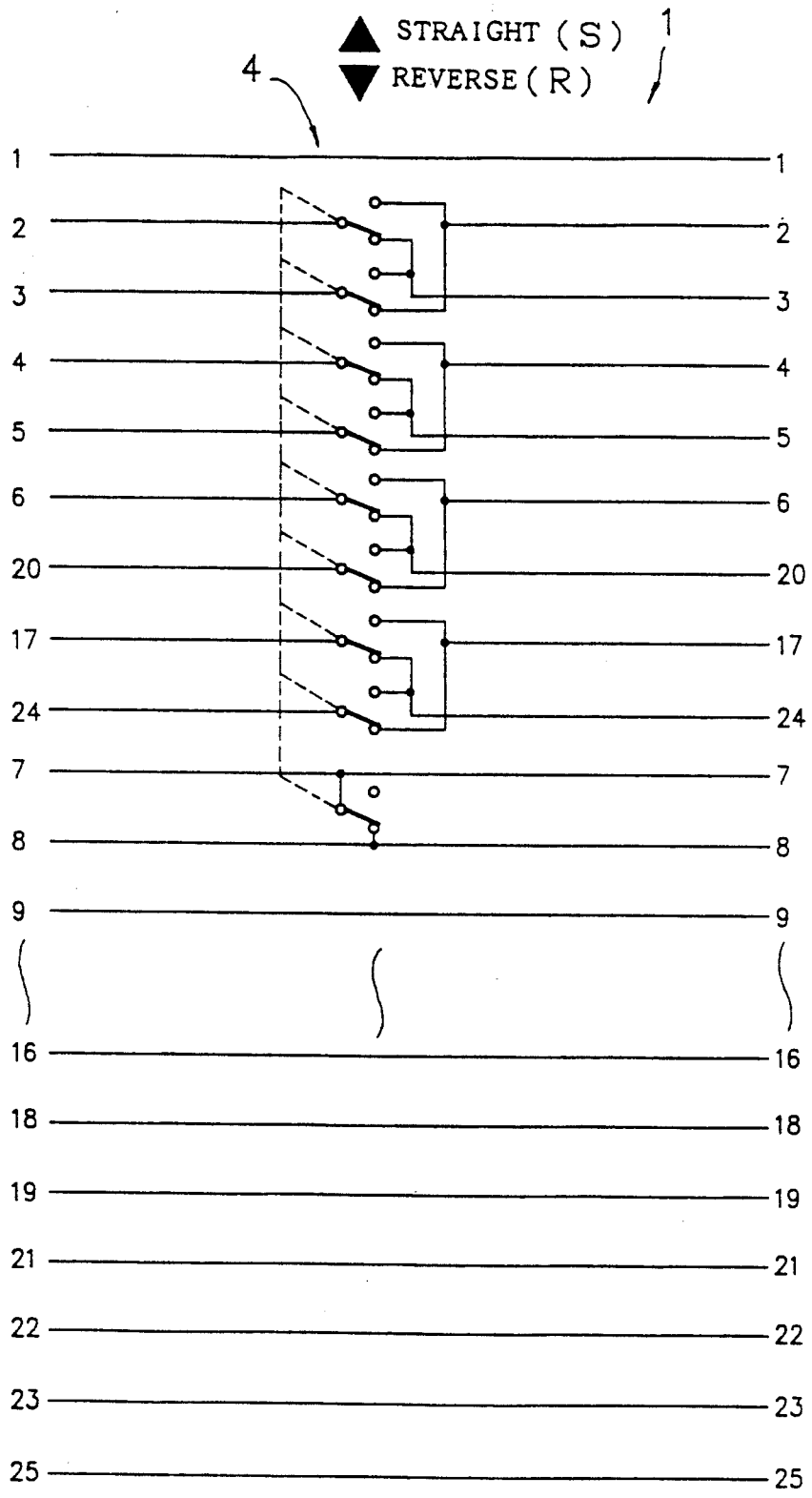
FIG. 3 is a circuit diagram showing the manner in which wires of the switching cable are to be selectively connected.

FIG. 3 is a circuit diagram showing the manner in which the internal wires of the switching cable 1 are to be selectively connected. Each connector of this switching cable 1 is composed of 25 pins; five sets of pins, i.e., Nos. 2 and 3, Nos. 4 and 5, Nos. 6 and 20, Nos. 17 and 24, and Nos. 7 and 8 are switched over between straight connection (S) and reverse connection (R) by the rotary switch 4, which includes nine circuits and two contact points.

Figure 2:
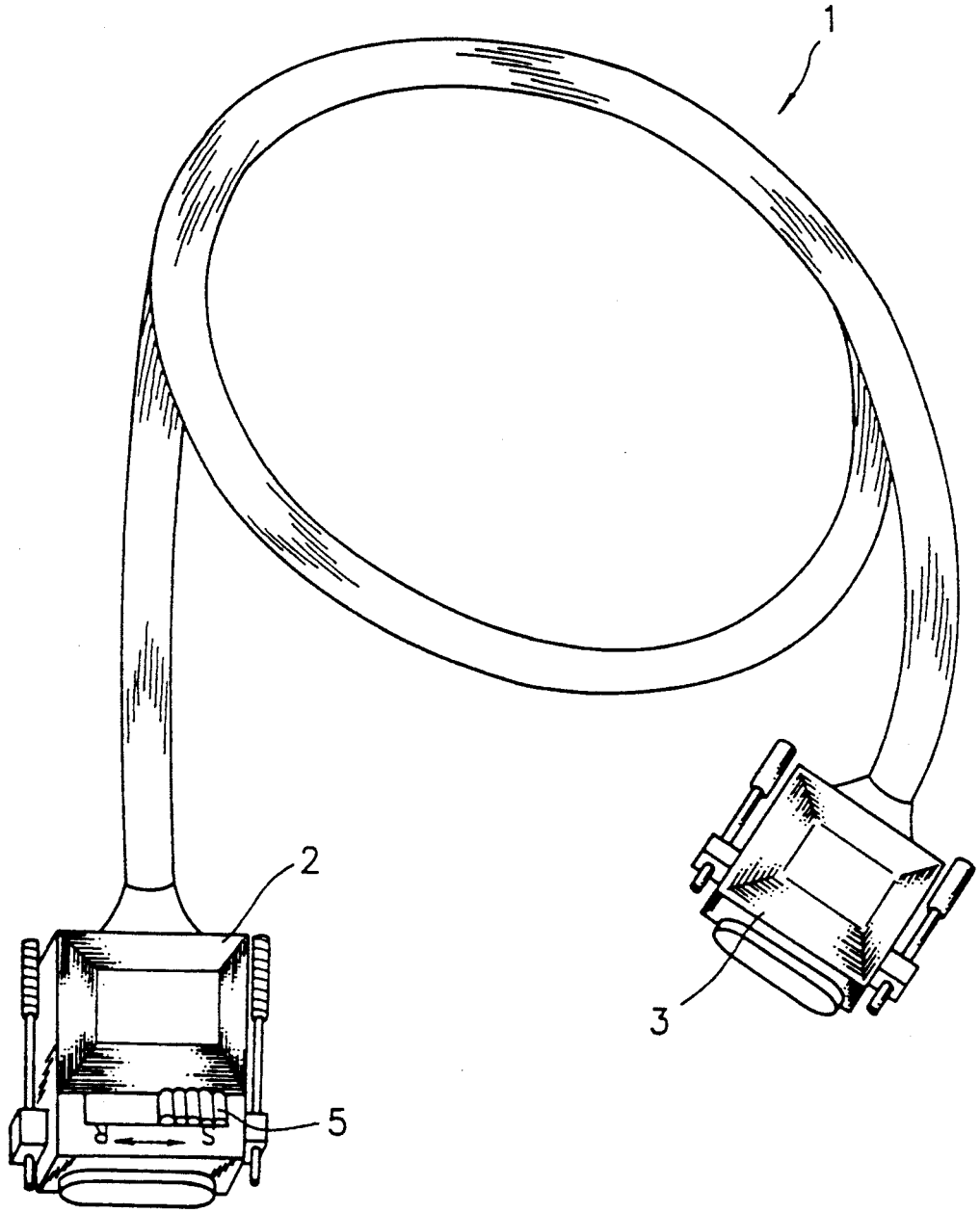
FIG. 2 is a perspective view of a modified switching cable according to another embodiment of the invention.

The switching device should by no means be limited to the rotary switch 4, and may be a slide switch 5 as shown in FIG. 2. The switching device may be mounted on each of the opposite connectors.

Since the switching cable of this invention can be switched over between straight connection and reverse connection according to the use, it is free from the conventional problem that a wrong cable might be taken out of two kinds of cables, and it is also possible to reduce the number of goods in stock in a shop to half.

In use, when a computer and a peripheral equipment are to be connected to one another by the switching cable 1, it is necessary to connect the sending terminal of the computer to the receiving terminal of the peripheral equipment and to connect the receiving terminal of the computer to the sending terminal of the peripheral equipment.

In some of computers or peripheral equipments, even when the sending terminal of one computer is connected to the sending terminal of the other or when the receiving terminal of one computer is connected to the receiving terminal of the other, yet the same result as the one obtained when connecting the sending terminal to the receiving terminal and vise versa can be obtained, depending on the functions of the internal circuits. If this is the case, the switching cable 1 is switched over to the straight connection (S). In other words, with some pins of one connector directly connected to the corresponding pins of the other, the sending terminal of one computer is connected to the sending terminal of the other or the receiving terminal of one computer is connected to the receiving terminal of the other.

In other computers or peripheral equipments not having the above-mentioned functions of the internal circuits, the switching cable 1 is used as switched over to the reverse connection (R). Namely the state of connection of the individual pins between a pair, of companion connectors is switched over, whereby the sending terminal of one computer is directly connected to the receiving terminal of the other via the switching cable 1.

What is claimed is:

1. A switching cable for connecting a computer to another machine, said switching cable comprising:

(a) a pair of connectors each having a plurality of pins;

(b) a plurality of wires for connecting the individual pins of one of said connectors with the individual pins of the other connector; and (c) switching means mounted on at least one of said connectors, said switching means being a rotary switch for switching over a connecting state of said pins between a straight connection wherein said pins of said connectors are connected in a corresponding relationship and a reverse connection wherein at least one pin of a first connector is connected with a pin of a second connector which is not in said corresponding relationship so that the one switching cable can be sued for both straight and reverse connection.

2. A switching cable for connecting a computer to another equipment, comprising:

a pair of connectors having pairs of pins, each of said connectors including 25 pins having pin Nos. 1 through 25, five pairs of the pins being switchable between straight and reverse connections, said straight connection being such that said pins of said connectors are connected to each other in a corresponding relationship, said reverse connection being such that said pins of said connectors are connected to each other in a non-corresponding relationship;

a plurality of wires of making connection between said pins of said connectors; and switching means mounted on at least one of said connectors for switching over said connection between said straight and reverse connections, said switching means being a rotary switch having nine circuits and two contact points arranged such that said five pairs of pins are switched over between said straight and reverse connections,

3. A switching cable according to claim 2, wherein said five switchable pairs are pin Nos. 2 and 3, Nos. 4 and 5, Nos. 6 and 20, Nos. 17 and 24, and Nos. 7 and 8.

4. A switching cable according to claim 3, wherein said five pin pairs Nos. 2 and 3, Nos. 4 and 5, Nos. 6 and 20, Nos. 17 and 24, and Nos. 7 and 8 of a first connector are connected to corresponding pin pairs Nos. 2 and 3, Nos. 4 and 5, Nos. 6 and 20, Nos. 17 and 24, Nos. 7 and 8 of a second connector in

5. A switching cable according to claim 3, wherein said five pin pairs Nos. 2 and 3, Nos. 4 and 5, Nos. 6 and 20, Nos. 17 and 24, and Nos. 7 and 8 of said first connector are connected to pin Nos. 3 and 2, Nos. 5 and 4, Nos. 20 and 6, Nos. 24 and 17, and Nos. 8 and 7 of said second connector, respectively, in said reverse connection.

* * * * *